US012121774B2

(12) United States Patent
Emmert

(10) Patent No.: US 12,121,774 B2
(45) Date of Patent: Oct. 22, 2024

(54) STILT DEVICE WITH IMPROVED LEG POLE ATTACHMENT BRACKET

(71) Applicant: Emmert Second Limited Partnership, Bethany, OK (US)

(72) Inventor: Raymond L. Emmert, Oklahoma City, OK (US)

(73) Assignee: Emmert Second Limited Partnership, Bethany, OK (US)

( * ) Notice: Subject to any disclaimer, the term of this patent is extended or adjusted under 35 U.S.C. 154(b) by 217 days.

(21) Appl. No.: 17/973,228

(22) Filed: Oct. 25, 2022

(65) Prior Publication Data

US 2024/0131398 A1 Apr. 25, 2024
US 2024/0226663 A9 Jul. 11, 2024

(51) Int. Cl.
*A63B 25/00* (2006.01)

(52) U.S. Cl.
CPC ..... *A63B 25/00* (2013.01); *A63B 2225/093* (2013.01)

(58) Field of Classification Search
CPC ..... A63B 25/00; A63B 2225/093
See application file for complete search history.

(56) References Cited

U.S. PATENT DOCUMENTS 3,346,882 A * 10/1967 Wilhoyte ..... A61F 3/00 182/230
3,902,199 A 9/1975 Emmert
6,517,586 B2 2/2003 Lin
7,108,640 B2 9/2006 Emmert
7,780,581 B1 * 8/2010 Emmert ..... A63B 25/10 135/65
10,039,956 B1 * 8/2018 Lin ..... A63B 25/00
2003/0203793 A1 * 10/2003 Emmert ..... A63B 25/00 482/75
2007/0027004 A1 * 2/2007 Novara ..... A63B 25/00 482/75
2011/0130251 A1 * 6/2011 Emmert ..... A63B 25/02 482/76
2022/0305343 A1 * 9/2022 Lin ..... A63B 25/06

* cited by examiner

*Primary Examiner* — Andrew S Lo
(74) *Attorney, Agent, or Firm* — Hall Estill Law Firm

(57) ABSTRACT

A leg attachment assembly for a stilt device of the type used to support a user above a base surface. The stilt device has a shoe plate supportable above a floor plate via front and rear struts and a leg attachment assembly configured to attach a leg of the user to the stilt via a leg attachment mechanism and a leg pole. A leg pole attachment assembly includes an exterior clamp bracket that forms an open-box with a c-shaped channel into which is disposed an interior swivel clamp. The interior swivel clamp has a base portion that swivels over a limited range of motion within the c-shaped channel and is affixed to a side portion of the exterior clamp bracket using a horizontally extending fastener. Opposing flanges of the swivel clamp extend around the leg pole and are interconnected using a second fastener that extends orthogonally to the first fastener.

24 Claims, 12 Drawing Sheets

STILT DEVICE WITH IMPROVED LEG POLE ATTACHMENT BRACKET

BACKGROUND

Stilt devices enable a user to perform work at an elevated height above a base surface. One area in which stilt devices are commonly used is the construction industry. A well-constructed pair of stilts can enable a worker to efficiently carry out construction operations at an increased elevation several inches or feet above an underlying floor level, thereby eliminating the need to erect a scaffold, ladder or other fixed support structure to support the worker at a desired elevation.

A number of useful stilt devices are known in the art, such as taught in U.S. Pat. Nos. 3,902,199, 7,108,640 and 8,172,730, each of which is assigned to the assignee of the present disclosure and incorporated herein by reference. These and other stilt devices of the existing art can be adjustable in height over a selected range through the use of telescopic struts. These stilts also have adjustable leg attachment features to conform to the body type and size of the individual user. In this way, a particular pair of stilt devices may be configured to adjust to a large range of applicable operational heights and can be adjusted to accommodate the different body types of individual users.

It is important that stilt devices be steady and secure, particularly at interface locations between the user's legs and the stilts. Ideally, a user should be able to stand and walk about on a pair of stilts with essentially the same security and control as if the user were directly walking on the underlying base support surface above which the user is raised. As such, the center of gravity of the user should be nominally centered with and aligned over the combined center of gravity of the user and the stilts.

Accordingly, while existing stilt devices have been found operable in this regard, there remains a continual need for improvements in stilt designs to enhance usefulness, safety and comfort for a user. It is to these and other improvements that various embodiments of the present disclosure are generally directed.

SUMMARY

Various embodiments of the present disclosure are generally directed to an improved stilt device that utilizes a novel and improved leg pole attachment assembly configuration. It is contemplated although not required that each stilt device will form a portion of a pair of stilt devices, one adapted to be attached and worn by the left leg of the user, and another adapted to be attached to and worn by the right leg of the user, with the respective left-side and right-side stilt devices being mirrored but otherwise identical.

Without limitation, some embodiments provide a leg attachment assembly for a stilt device of the type used to support a user above a base surface. The stilt device has a shoe plate supportable above a floor plate via front and rear struts and a leg attachment assembly configured to attach a leg of the user to the stilt via a leg attachment mechanism and a leg pole. A leg pole attachment assembly includes an exterior clamp bracket that forms an open-box with a c-shaped channel into which is disposed an interior swivel clamp. The interior swivel clamp has a base portion that swivels over a limited range of motion within the c-shaped channel and is affixed to a side portion of the exterior clamp bracket using a horizontally extending fastener. Opposing flanges of the interior swivel clamp project from the base portion to extend around a medial portion of the leg pole and are interconnected using a second fastener to clamp the leg pole to the interior swivel clamp, and from that to the exterior clamp bracket.

These and other features and advantages which characterize various embodiments will be apparent from a reading of the following detailed description and a review of the associated drawings.

It will be understood that the various drawings are representative in nature and are not necessarily drawn to scale or with precise aspect ratios, etc. Nevertheless, the drawings are sufficiently clear and detailed to enable a full understanding of the disclosed subject matter.

DETAILED DESCRIPTION

Various embodiments of the present disclosure are generally directed to stilt devices of the type configured to enable a user to stand, walk and work at an elevated height above a base (e.g., floor) surface.

Figure 1A:
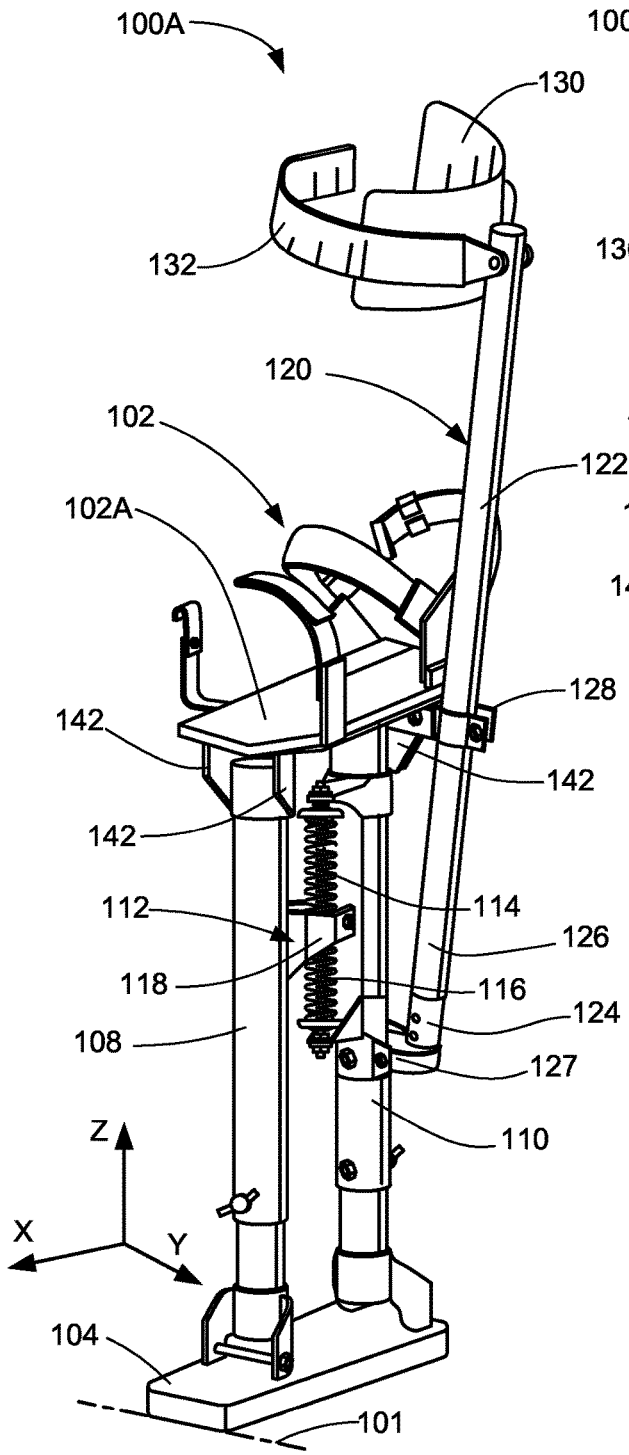
FIG. 1A (Related Art)
FIG. 1A is a front isometric view of a prior art stilt device constructed and operated in accordance with the related art.
Figure 1B:
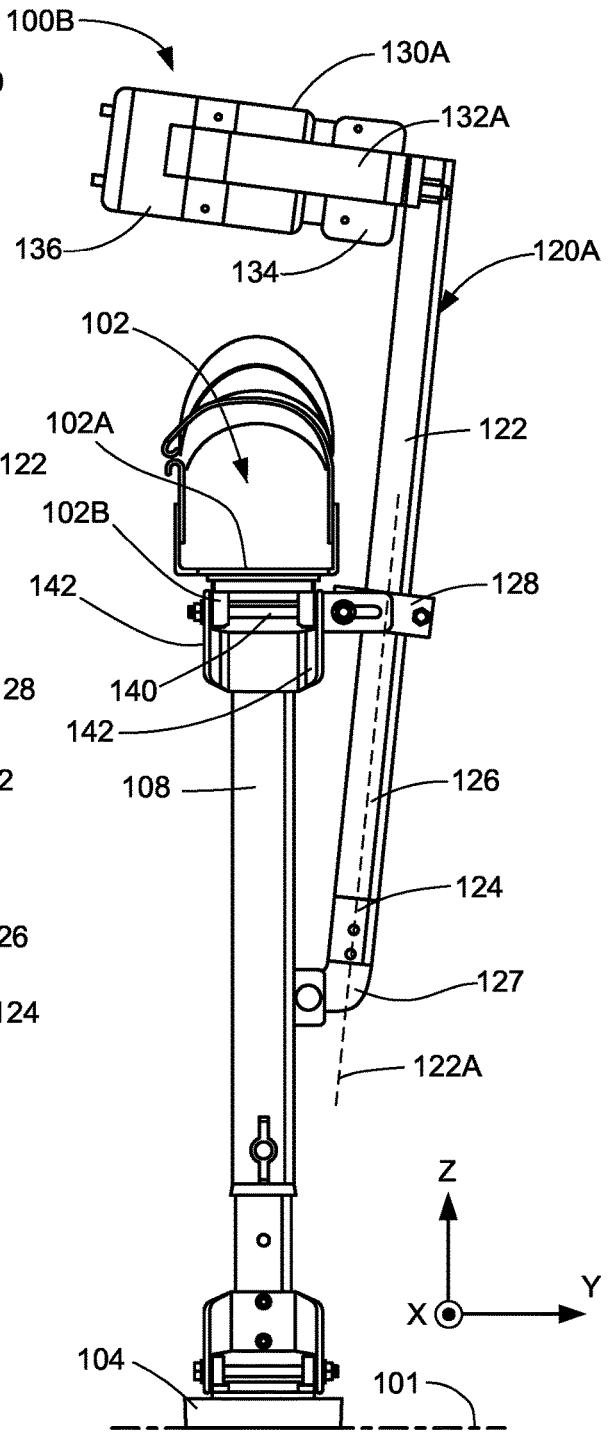
FIG. 1B (Related Art)
FIG. 1B is a front-facing, elevational view of a second prior art stilt device of the related art that is similar to the stilt device of FIG. 1A.

Reference is first made to FIGS. 1A and 1B which show respective stilt devices 100A and 100B ("stilts") of the related art in order to depict different operational environments in which various embodiments of the present disclosure can be advantageously implemented.

The stilt devices 100A and 100B are nominally identical except that the respective devices use different configurations of leg attachment mechanisms (e.g., those portions of the stilts that contactingly engage the user's leg). As such, the same reference numerals have been used throughout this disclosure for identical components appearing in each of the drawings set forth herein.

Orthogonal axes X, Y and Z are denoted for purposes of reference, with X extending along a longitudinal (forward) direction, Y extending in a lateral (transverse) direction, and Z extending along a vertical direction. For clarity, the X direction aligns with the forward direction of travel of a user wearing the stilts, the Y direction extends to the side away from the center of mass of the user, and Z is the vertical direction above a floor (support surface 101) over which the user is elevated. It will be noted that the support surface 101 extends along an X-Y plane.

Each of the stilt devices 100A, 100B form one of a pair of devices that can be used to support the user above the underlying support surface 101. Each pair of stilts includes a left-side stilt for attachment to and support of the user's left leg, and a mirrored right-side stilt for attachment to and support of the user's right leg. It will be noted that both of the stilts 100A and 100B in FIGS. 1A and 1B are configured as left-side stilts.

A normally horizontal foot plate 102 is configured to attach to a shoe or boot worn by the user. A floor plate 104 is provided to contact the underlying support surface 101. Front and rear vertically extending struts 108, 110 are pivotally attached to and extend upwardly from the floor plate 104 in the Z direction to pivotally support the foot plate 102. The front and rear struts 108, 110 are telescopic to permit selective adjustment of the height in the Z direction that the associated stilt devices will elevate the user. Such Z axis adjustability is desirable but not necessarily required.

A damping assembly 112 interconnects the front and rear struts 108, 110 to bias the stilts in a parallelogram relationship as depicted in FIG. 1A. The damping assembly 112 comprises upper and lower damping springs 114, 116 that are affixed by brackets to the rear strut 110 and to a rigid actuator arm 118. The actuator arm 118 is attached to, and extends from, the front strut 108 to a medial position between the springs 114, 116. Other damping mechanism arrangements can be used.

In addition to maintaining the nominal parallelogram relationship of the struts 108, 110, the damping assembly 112 provides flexibility and cushioning to the user by permitting limited forward and rearward pivoting of the struts 108, 110 with respect to the foot plate 102 and the base member 104 as the user walks or moves.

A leg attachment assembly 120 serves to support a portion of the user's leg just below the user's knee. The leg attachment assembly 120 has a telescopic leg support pole 122 that can be adjusted as desired to properly fit the user's leg length. The leg support pole 122 includes an inner sleeve 124 and an outer sleeve 126, with the lower end of the inner sleeve 124 attached to the rear extendible strut 110 by a connector assembly 127.

The length and angle of the leg support pole 122 can be adjusted and secured using a leg attachment clamp 128 which engages a medial portion of the outer sleeve 126. It will be noted that the foregoing features also appear in a corresponding leg attachment assembly 120A in FIG. 1B. While a telescopic leg support pole 122 is contemplated, such is not necessarily required.

The leg attachment assembly 120 in FIG. 1A has a leg attachment mechanism that includes a band member 130 (or "leg band") and one or more attachment straps 132. The leg band 130 is a curvilinearly extending, rigid support formed of metal, plastic, or other suitable material. The strap(s) 132 are formed of a durable, flexible material such as leather, nylon, etc. The stilt 100A is attached to the user's left leg by placing the outside of the user's left leg against the leg band 130, wrapping the strap(s) 132 around the inner portion of the leg from one side to the other of the leg band 130, and tightening the strap(s) using a suitable tightening mechanism such as a buckle (not separately shown). In this way, the leg band 130 and strap 132 circumferentially extend around the user's left leg below the knee to secure the leg pole 122 to the user's left leg. As noted above, similar arrangement is used for the right-side stilt (not shown) of the pair of stilt devices to attach to the user's right leg.

The stilt device 100B in FIG. 1B uses a clamshell member 130A and an attachment strap 132A. The clamshell member 130A uses spring loaded hinged band members 134, 136 (leg bands) which can be opened and closed to surround the user's left leg below the knee. Once in place, the leg bands 134, 136 are secured using the strap 132A. As before, the leg bands 134, 136 can be formed of any suitable material such as metal, plastic, etc., and serve to circumferentially extend around the user's left leg to attach the user's left leg to the pole 122. As before, a right-side stilt is provided (not shown) with mirrored features to attach to the user's right leg. It will be appreciated that other forms of leg attachment assemblies can be used apart from those shown in FIGS. 1A and 1B as desired.

To facilitate walking movement of the user via the stilts, the shoe plate 102 is pivotally attached to each of the respective front and rear struts 108, 110 using respective front and rear threaded fasteners 140 that extend through associated wing flanges 142. The wing flanges 142 extend upwardly in the Z direction from the tops of each of the front and rear struts 108, 110 in a spaced apart relationship. The fasteners 140 are aligned in the Y direction to extend through and attach the wing flanges 142 to boss features 102B of the shoe plate 102. This attachment arrangement can be best seen in FIG. 1B.

Figure 1C:
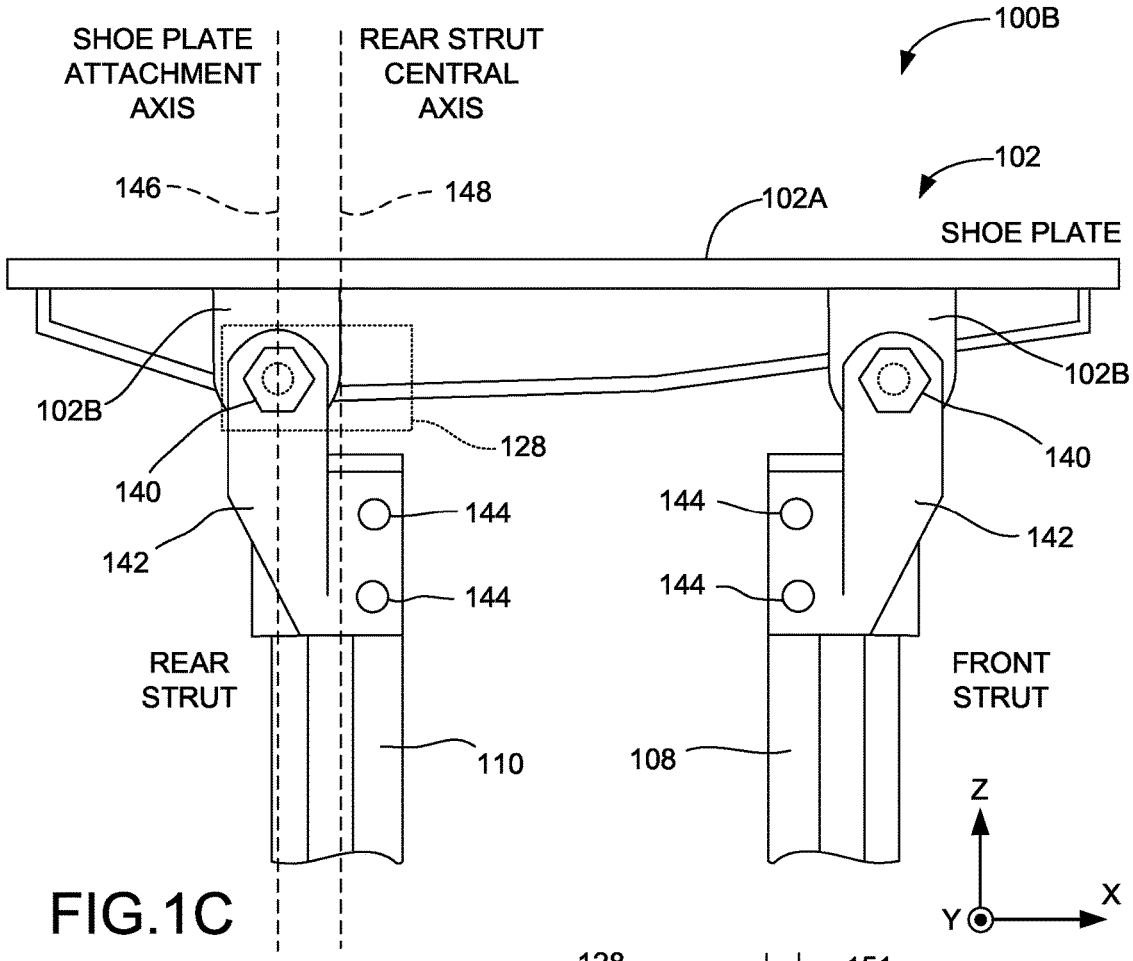
FIG.1C (Related Art)
FIG. 1C is a schematic representation of a shoe plate and associated leg pole attachment arrangement of the related art stilt device of FIG. 1B.

FIG. 1C shows a side elevational view of various elements of interest in the stilt device 100B in FIG. 1B. Similar features are provided for the stilt device 100A in FIG. 1A. The upper foot support surface 102A of the shoe plate 102 is configured to contactingly support the sole of the foot/shoe/boot of the user, and the laterally spaced apart support and strengthening boss features 102B extend downwardly from the upper foot support surface 102A as shown. The boss features 102B have through hole apertures that are placed between the wing flanges 142 to enable passage of the respective front and rear foot plate attachment fasteners 140 in the Y direction (see FIG. 1B). The wing flanges 142 are secured to the topmost portions of the front and rear struts 108, 110 such as via rivets 144 (see FIG. 1C). Other attachment arrangements can be used. The threaded fasteners 140 take the form of elongated threaded bolts, lock nuts, washers, etc., or any other suitable forms as desired.

As best viewed in FIG. 1C, the attachment locations of the threaded fasteners 140 are axially offset (outbound in the X direction) from the respective struts 108, 110, as shown by a vertically extending shoe plate attachment axis 146 which intersects the rear fastener 140, and a vertically extending rear strut central axis 148 which intersects the rear strut 110. Similar offsets are provided for the front fastener 140 and the front strut 108. These offsets provide a number of advantages such as enhanced stability and reduced user effort during walking. However, it will be appreciated that such offsets are merely exemplary and are not necessarily required.

Figure 1D:
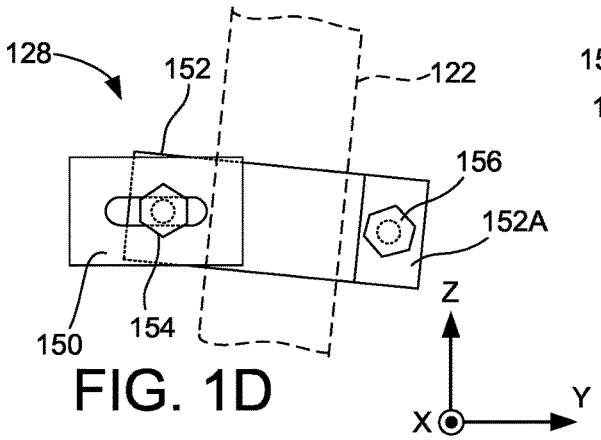
FIG. 1D (Related Art)
FIG. 1D is a side elevational representation of the related art attachment arrangement of FIGS. 1B-1C.
Figure 1E:
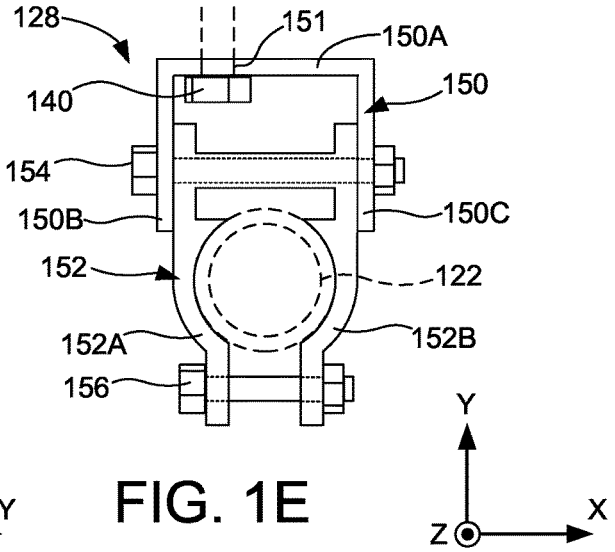
FIG. 1E (Related Art)
FIG. 1E is a top plan schematic representation of the related art arrangement of FIG. 1D.

As further shown in FIGS. 1D and 1E, the leg pole attachment clamp 128 is attached to the shoe plate 102 using the rear fastener 140 as a convenient attachment point. To this end, the rear fastener 140 is passed through a base portion 150 of the clamp 128 before passing through the respective wing flanges 142 and boss features 102B. As best viewed in FIG. 1E, the base portion 150 is a u-shaped exterior clamp bracket with base member 150A and spaced apart flanges 150B, 150C that extend from opposing ends of the base member 150A. It will be noted that the flanges 150B, 150C are vertical flanges (e.g., extend in the Z direction) and are separated by an intervening horizontal spacing along the X direction. The base member 150A has an offset through-aperture 151 through which the fastener 140 extends. In this way, the fastener 140 is offset along the base member 150A to nominally align the leg pole 122 in the Z direction with the rear strut 110.

An interior clamp member 152 pivotally extends between the respective flanges 150B, 150C and is secured thereto using a threaded fastener 154. Spaced apart flanges 158A, 158B extend along opposing sides of the leg pole 122 and are clamped thereto using threaded fastener 156.

The related art leg clamp 128 as now variously depicted in FIGS. 1A through 1E has been found to provide a number of advantages, including enhanced ability to adjust the central axis of the leg pole (line 122A in FIG. 1B) to a desired angle for user comfort. However, the offset in the X direction between vertical axes 146, 148 (see FIG. 1C) has been found difficult to fully compensate, so that in practice the leg clamp 128 can in some cases cause the leg pole 122 to not be fully aligned with the rear strut 110 in the Z direction. For example, if the leg pole extends even slightly toward the rear of the shoe plate 102, this position can cause user discomfort after extended use of the stilts. Further details regarding the related art leg clamp 128 can be found in U.S. Pat. No. 7,108,640 to Emmert, assigned to the assignee of the present disclosure and hereby incorporated by reference.

The leg clamp 128 as described in FIGS. 1A-1E was introduced by the present inventor several years ago as an improvement to address limitations associated with prior forms of leg attachment arrangements that had been previously provided in the prior art. These previous leg attachment arrangements are depicted in FIGS. 2A through 2C, which illustrate aspects of another, older stilt device 100C similar to the stilt devices 100A, 100B.

Figure 2A:
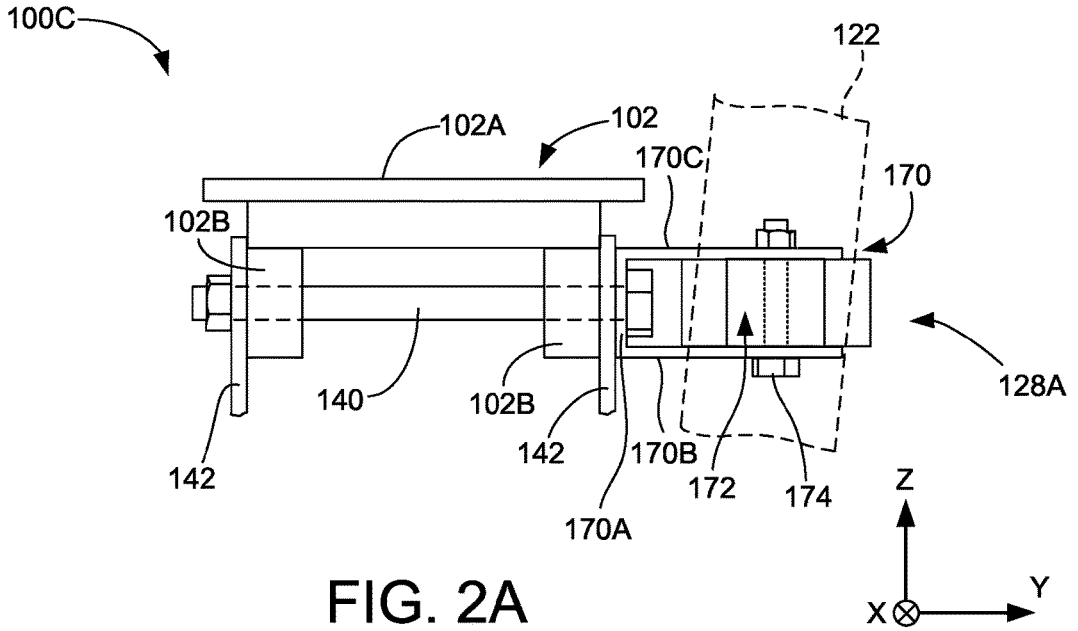
FIG. 2A (Related Art)
FIG. 2A is an end view representation of another prior art stilt device in accordance with the related art.
Figure 2B:
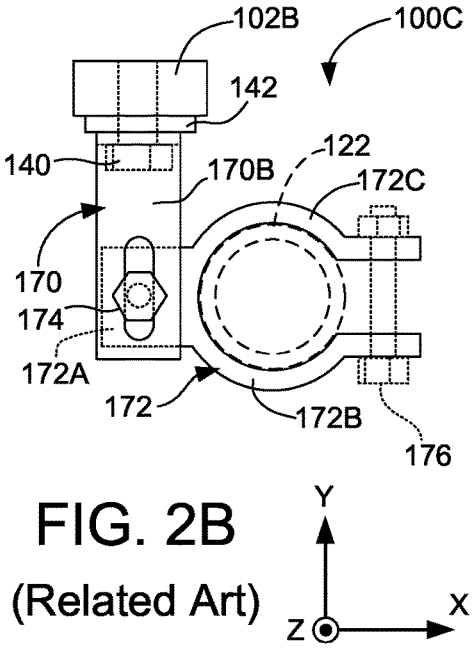
FIG. 2B (Related Art)
FIG. 2B is a top plan schematic representation of the leg pole attachment arrangement of FIG. 2A.
Figure 2C:
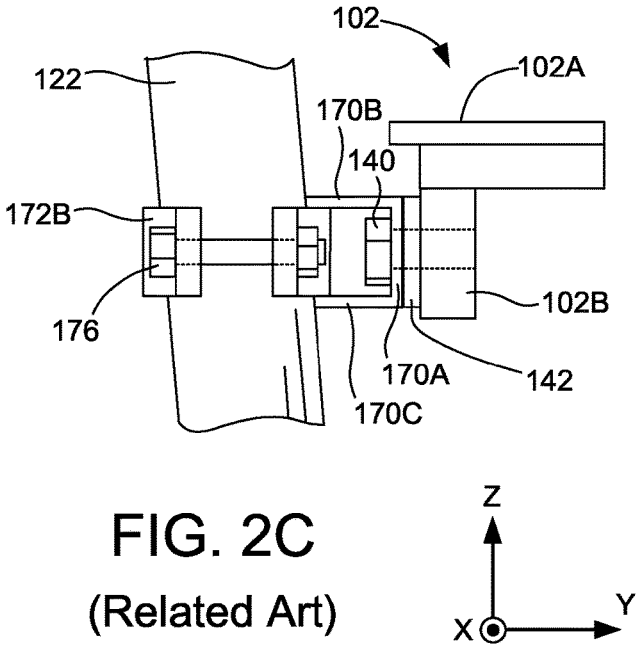
FIG. 2C (Related Art)
FIG. 2C is a side elevational view of the leg pole attachment arrangement of FIG. 2A.

In FIGS. 2A-2C, the related art stilt device 100C uses a leg pole attachment clamp 128A with an exterior base portion 170. The base portion 170 is a u-shaped member with base member 170A and upper and lower, spaced apart flanges 170B, 170C. The flanges 170B, 170C are each normally horizontal and are spaced apart in the vertical Z direction. As best viewed in FIG. 2B, the fastener 140 extends through the base member 170A and the flanges 170B, 170C extend adjacent to and behind the leg pole 122 with respect to the front of the stilt 100C (e.g., in the X direction).

An interior clamp 172 has a base member 172A and spaced apart flanges 172B, 172C. A first fastener 174 affixes the base member 172A of the interior clamp 172 to the flanges 170B, 170C and a second fastener 176 connects the flanges 170B, 170C about the leg pole 122. For reference, a clamp arrangement similar to the leg pole attachment clamp 128A is provided in U.S. Pat. No. 3,902,199 to Emmert, assigned to the assignee of the present disclosure and hereby incorporated by reference. Other prior art references that use upper and lower offset horizontal flanges and a vertical clamping fastener as taught by the '199 patent include the subsequently filed U.S. Pat. No. 6,517,586 and U.S. Published Patent Application No. 2007/0027004.

An advantage of the user of upper and lower offset horizontal flanges 172B, 172C and vertical fastener 174 therethrough as shown by the clamp 128A is the ability to easily align the leg pole 122 with the rear strut 110 in the vertical Z direction. This is due to the offset location of the exterior clamp bracket 170, which enables the flanges 172B, 172C to be aligned with the fastener 140.

However, a limitation associated with this arrangement is that it is difficult to obtain and secure the desired angle of the leg pole 122 as the leg clamp 128A is tightened. In practice, it has been found necessary in some cases to deform the horizontally extending upper and lower flanges 170B, 170C downwardly in order to adequately secure the interior clamp 172, and hence the leg pole 122, to the shoe plate 102 in the desired angular position (axis 122A in FIG. 1B), particularly for larger angles for the leg pole.

Figure 3:
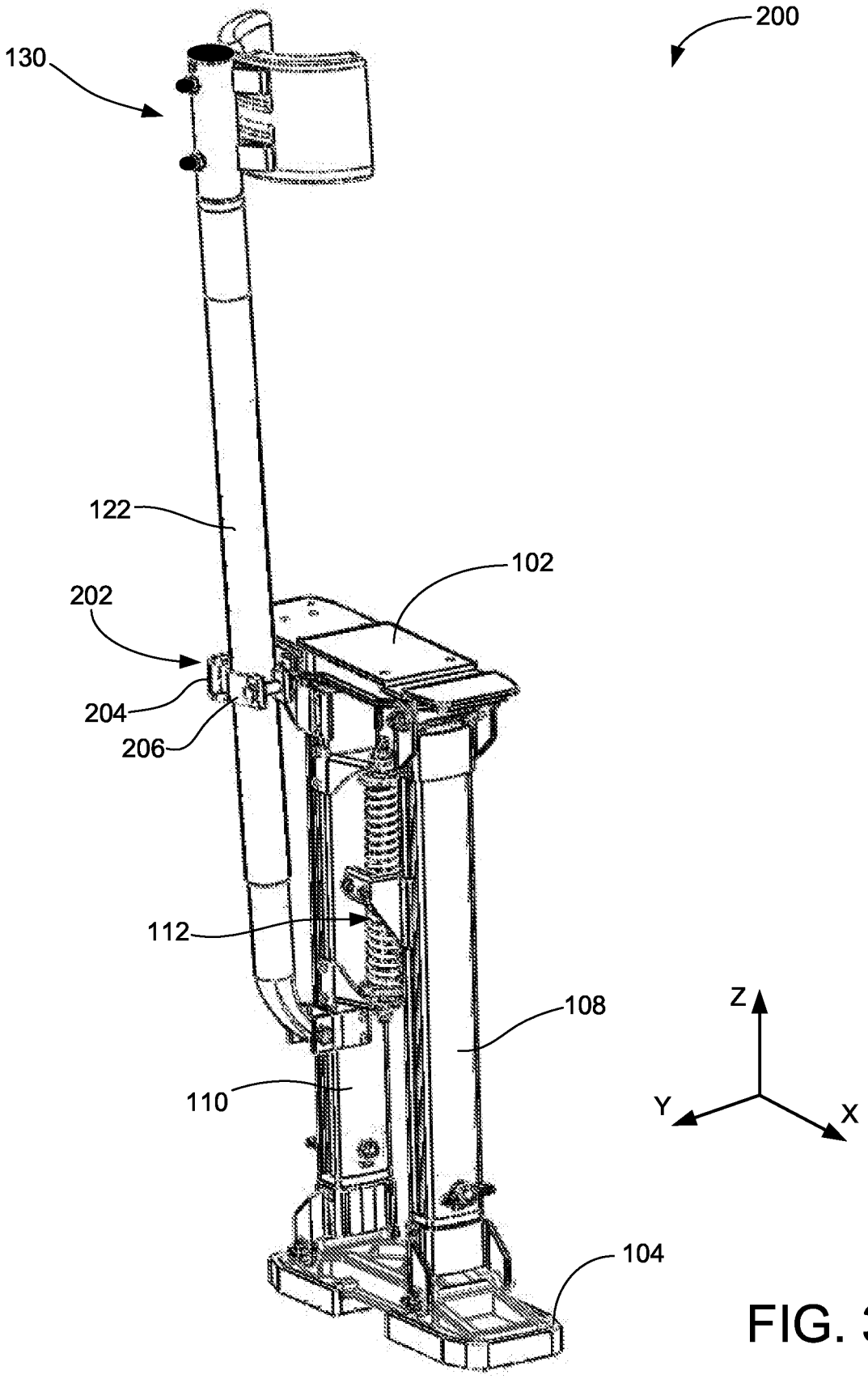
FIG. 3 is an isometric view of a stilt device constructed and operated in accordance with various embodiments of the present disclosure.

Accordingly, FIG. 3 shows another stilt device 200 constructed and operated in accordance with various embodiments. The stilt device 200 is similar to the various prior art stilt devices 100A through 100C except as noted below, and therefore the same reference numerals have been used for similar components. In this case, the stilt device 200 is a right-side stilt for a pair of stilts to be worn by the user, with the other stilt in the pair of stilts being a mirrored, left-side stilt otherwise identical to the right-side stilt.

The stilt device 200 has an improved leg pole attachment assembly 202 that addresses the aforedescribed limitations of the prior art. As further shown in FIGS. 4 and 5, the leg pole attachment assembly 202 includes an exterior clamp bracket 204 and an interior clamp 206. The exterior clamp bracket 204 is sometimes also referred to as an extension or extrusion clamp bracket, and the interior clamp 206 is sometimes also referred to as a swivel clamp. The exterior clamp bracket 204 is affixed to the shoe plate 102 via the fastener 140 as before. A first fastener 208 (best viewed in FIG. 5) affixes the interior clamp 206 to the exterior clamp bracket 204 at a desired rotational position. A second fastener 210 (best viewed in FIG. 4) secures the interior clamp 206 to the leg pole 122.

It will be noted that the fastener 208 nominally extends horizontally (e.g., in the X direction), and the fastener 210 extends somewhat horizontally but may be tilted upwardly with reference to the horizontal X-Y plane based on the amount of swivel induced in the swivel clamp 206 as the leg pole 122 is adjusted to the desired angle. Both fasteners 208, 210 may be threaded bolts sized to have common bolt head sizes to permit the use of the same tightening tool (e.g., wrench, etc.) during adjustment operations. Additional elements such as flat washers, lock washers, spacers, lock nuts, etc. can be incorporated into these fastener arrangements as desired, but such have not been illustrated for simplicity of illustration.

FIGS. 6A through 6H provide various illustrated views of the exterior clamp bracket 204 in accordance with some embodiments. Other configurations can be used so that the arrangements in FIGS. 6A-6H are merely exemplary and are not limiting.

Figure 6A:
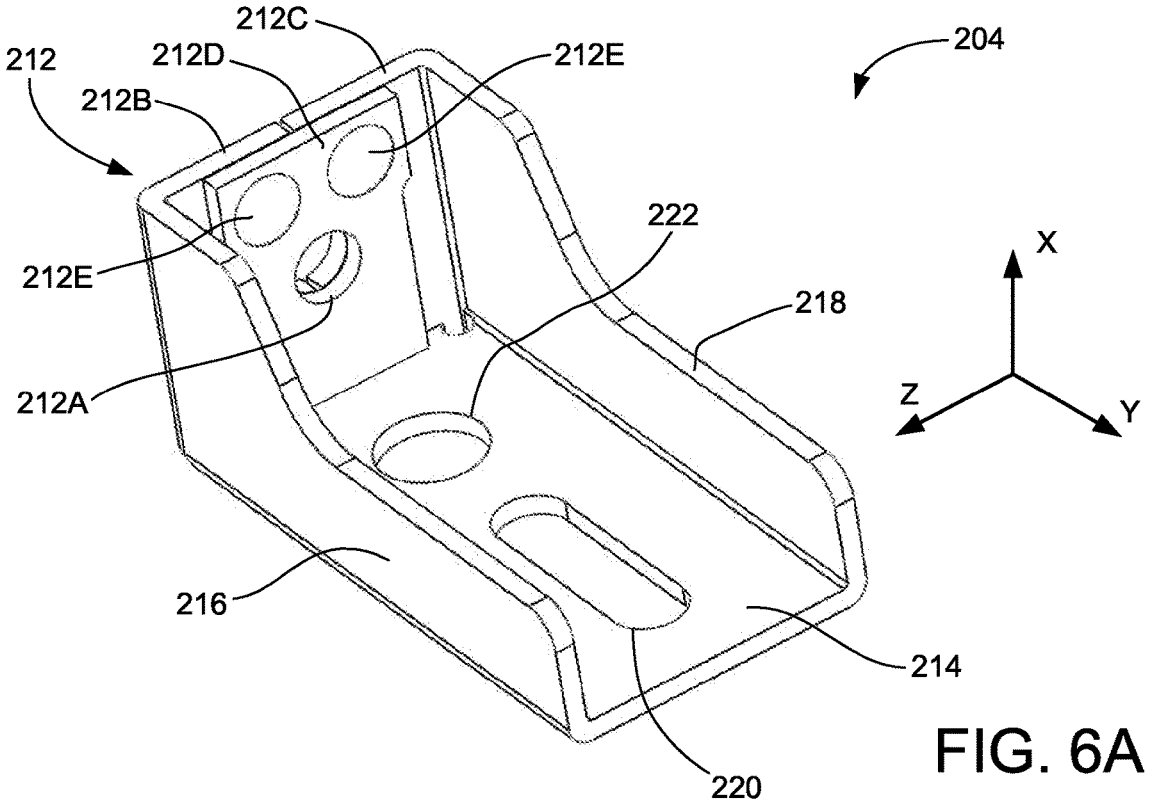
FIG. 6A is an isometric view of an exterior clamp bracket of the leg pole attachment assembly of FIGS. 3-5.
Figure 6B:
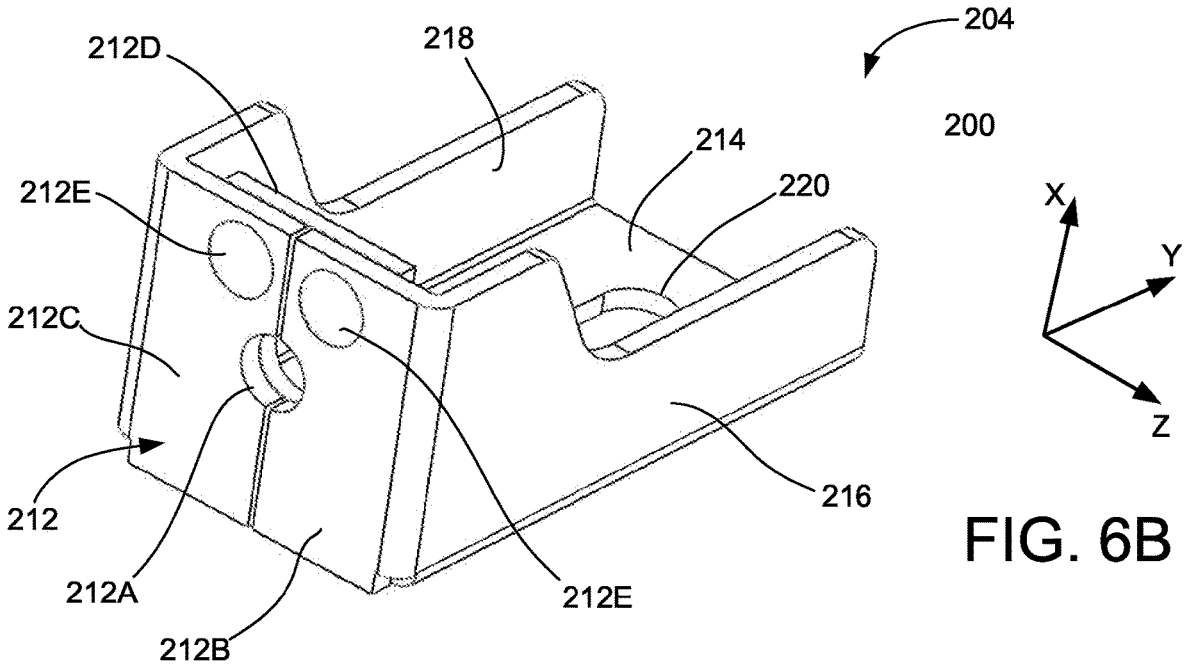
FIG. 6B is another isometric view of the exterior clamp bracket of FIG. 6A.

As best viewed in FIGS. 6A and 6B, the clamp bracket 204 takes a partially-enclosed box-shape with base portion 212, side portion 214 and opposing upper and lower retention flanges 216, 218. The side portion 214 is orthogonal to the base portion 212, and the retention flanges 216, 218 are orthogonal to both the base portion 212 and the side portion 214. The clamp 204 thus forms a generally c-shaped (open box) channel.

The base portion 212 has a through-hole aperture 212A to accommodate attachment of the exterior clamp bracket 204 to the shoe plate 102 via the fastener 140. In this way, the base portion 212 of the exterior clamp bracket 204 is pressingly disposed against the shoe plate 102, the c-shaped channel projects (extrudes) outwardly in the Y direction away from the shoe plate, and the opening of the c-shaped channel faces forward in the X direction toward the front of the stilt device 200. The respective sizes and shapes of the base portion 212 and the shoe plate 102 can be selected such that, when installed, the clamp bracket 204 remains orthogonal to the rest of the stilt device 200 (e.g., the side portion 214 is in a vertical plane, the upper and lower retention flanges are in horizontal planes, etc.) due to contacting engagement between surfaces of the respective clamp bracket 204 and remaining portions of the stilt device 200.

At this point it will be noted that the exterior clamp bracket 204 can take any number of different forms of construction including machining, extrusion, stamping, injection molding, printing, etc. The exterior clamp bracket 204 can be made of metal, plastic, ceramic, nylon, or any other desired material. The embodiment illustrated in FIGS. 6A through 6H is made using a sheet metal stamping, folding and spot welding process, so that the various features are formed from a flat layer of suitable sheet metal that is subsequently bent and welded to form the final bracket shape. The sheet metal can be any suitable material including stainless steel, aluminum, etc. and provided with a suitable thickness.

Figure 6C:
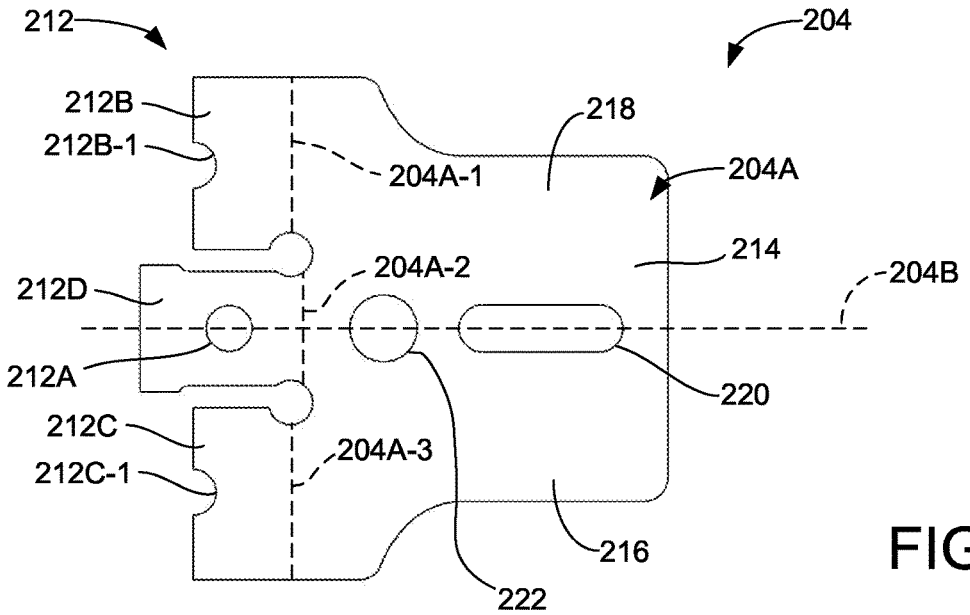
FIG. 6C is a top plan view of a planar sheet metal element from which the exterior clamp bracket of FIGS. 6A and 6B is formed in some embodiments.
Figure 6D:
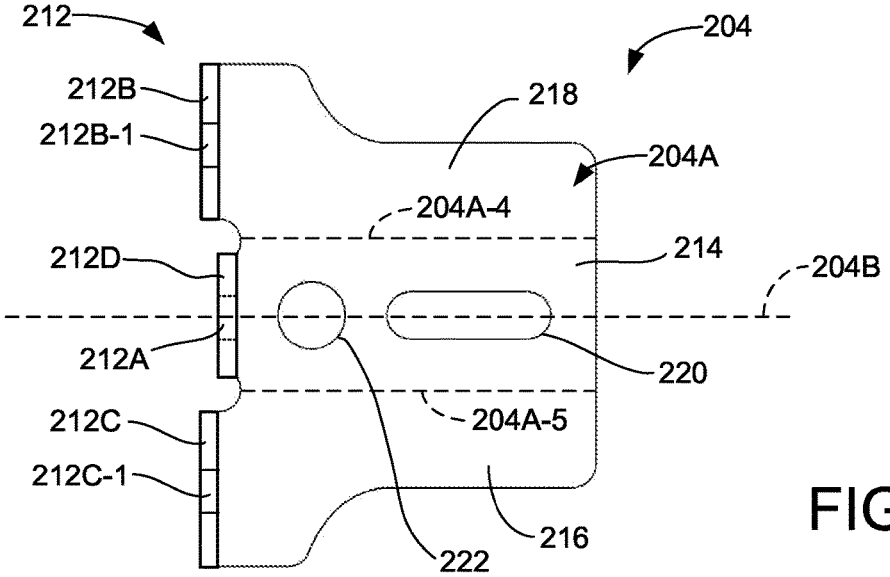
FIG. 6D shows the planar sheet metal element from FIG. 6C having a first series of bends (folds) applied thereto during a manufacturing process used to form the exterior clamp bracket of FIGS. 6A and 6B.
Figure 6E:
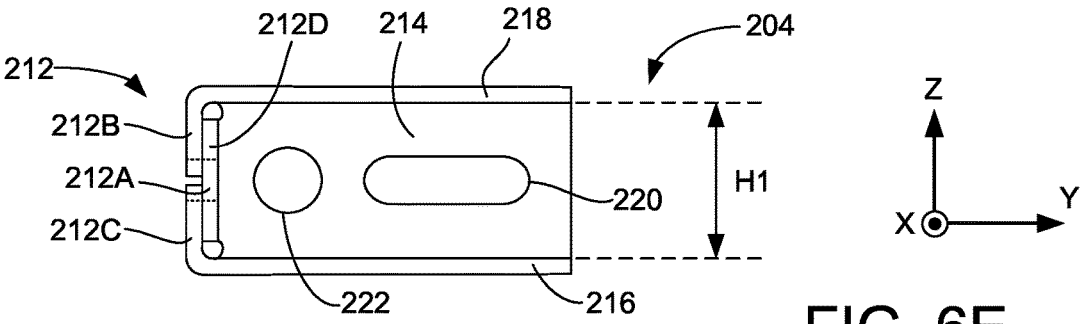
FIG. 6E shows the planar sheet metal element from FIG. 6D having a second series of bends (folds) and spot welding applied thereto during a manufacturing process to provide an interior view of the clamp bracket of FIGS. 6A-6B.

A particularly suitable construction methodology used to form the exterior clamp bracket 204 is illustrated by FIGS. 6C through 6E. As noted above, other methodologies can be used.

A flat (planar) piece of sheet metal 204A is cut (stamped) to have a general contour as shown in FIG. 6C. This contour is planar so that it lies along an initial plane, and is symmetric (mirrored) about a central axis 204B. The sheet metal piece 204 includes three tabs 212B, 212C and 212D which extend in parallel fashion from a first end. The tabs 212B and 212C are mirrored on opposing sides of the central axis 204B, and the tab 212D is a central tab bisected by the central axis 204B.

The tabs 212B, 212C and 212D are folded in a first operation as shown by FIG. 6D. The tabs are folded along fold lines 204A-1, 204A-2 and 204A-3 in FIG. 6C so as to extend in a first direction nominally orthogonal to the initial plane.

The flanges 216, 218 start out as side portions of the planar piece of sheet metal 204A and these are subsequently folded in a second operation transverse to the first operation as shown by FIG. 6E. These side portions are folded along fold lines 204A-4 and 204A-5. This folding operation places the flanges 216, 218 in a second direction that is nominally orthogonal to the first direction as well as to the initial plane. This second folding operation also rotates the tabs 212B, 212C into parallel facing abutment with the tab 212D, since the tab 212B extends from portion 218 and the tab 212C extends from portion 216. It will be noted that the first folds are orthogonal to the central axis 204B and the second folds are parallel to the central axis 204B.

Once folded into the final shape shown in FIG. 6E, the tabs 212B and 212C are spot welded to tab 212D as shown by spot welds 212E (see FIGS. 6A and 6B). Other attachment mechanisms can be used as desired. While not required, the completed bracket as shown in FIG. 6E can be plated using a suitable plating process (e.g., Zinc, etc.) for corrosion resistance purposes.

It will be noted that the aperture 212A shown in FIGS. 6A and 6B extends through the central tab (panel) 212D in FIG. 6C. The aperture 212A is further adjoined by semicircular opening 212B-1 in tab 212B and semicircular opening 212C-1 in tab 212C, both of which are further depicted in FIG. 6C.

Figure 5:
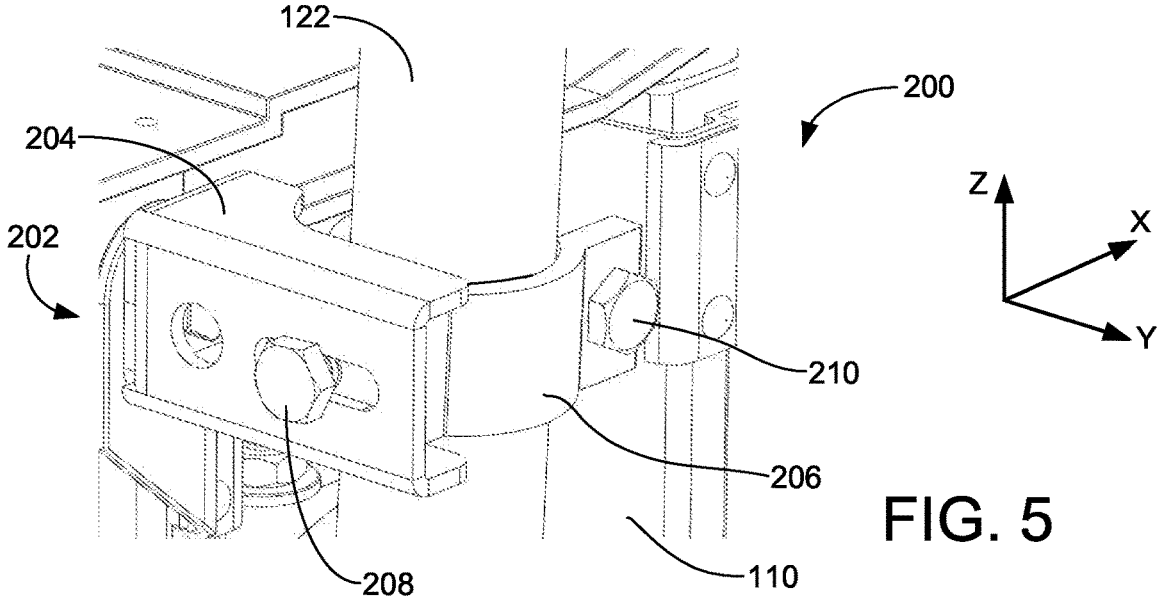
FIG. 5 is another view of the leg pole attachment assembly of FIG. 4.

An elongated aperture 220 extends through the side portion 214 to accommodate the first fastener 208 (see FIG. 5). While a single elongated aperture 220 is shown, one or more spaced apart circular openings at precisely defined locations can be used instead of a single elongated aperture, as desired.

An optional second aperture 222 is shown in the side portion 214 to provide a keying feature that can be used during the folding and/or spot welding operations represented in FIGS. 6D and 6E.

Continuing with the completed bracket 204 in FIG. 6E, an interior height H1 is provided as an interior distance between the respective flanges 216, 218. As explained below, this distance H1 is greater than the corresponding height of the interior clamp 206 to enable the interior clamp to swivel over a selected range within the c-shaped channel formed between the side portion 214 and the flanges 216, 218.

Figure 6F:
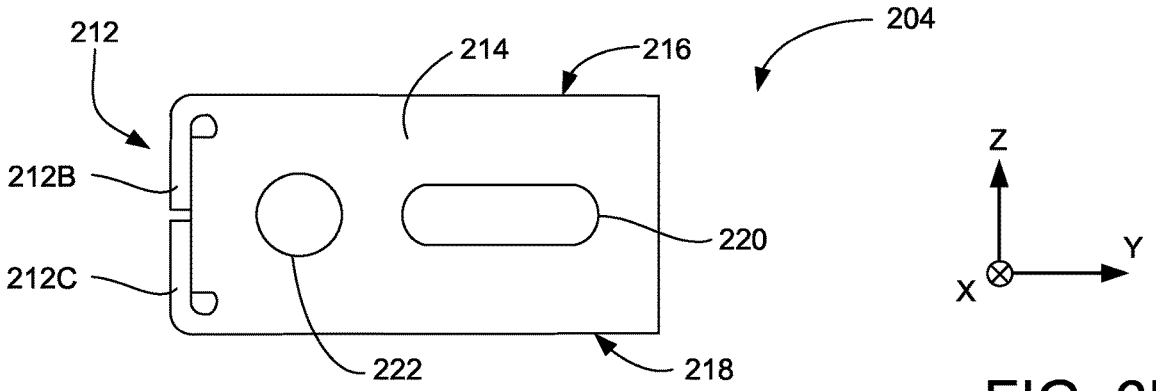
FIG. 6F is an exterior view of the clamp bracket rotated 180 degrees with respect to the view in FIG. 6E.
Figure 6G:
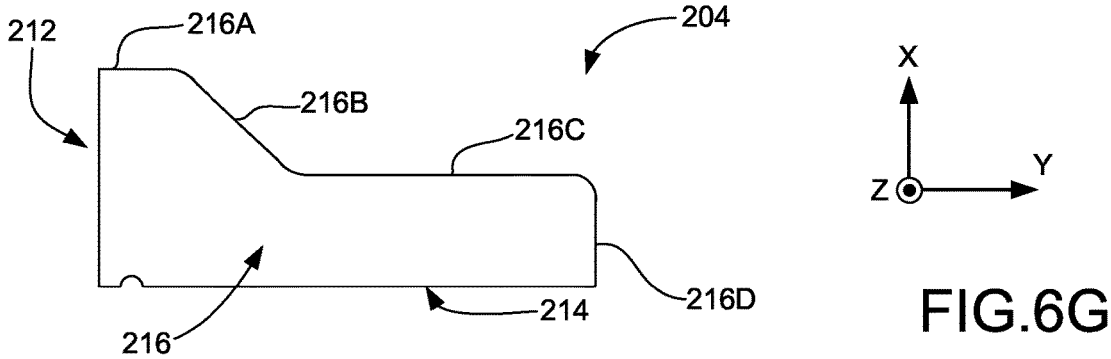
FIG. 6G is a top down representation of the exterior clamp bracket in some embodiments.
Figure 6H:
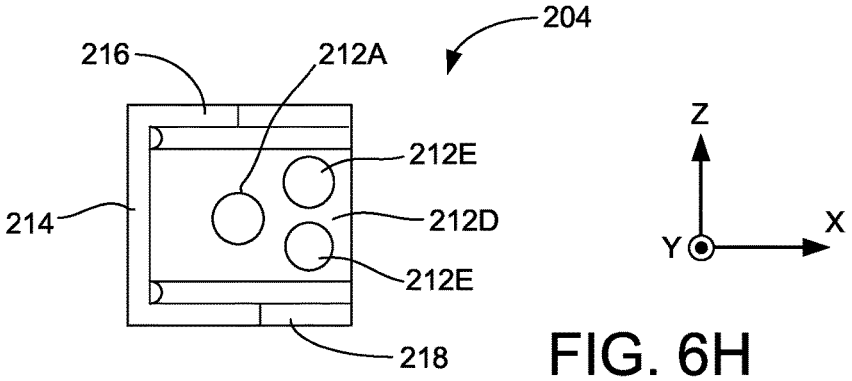
FIG. 6H is an end elevational representation of the exterior clamp bracket in some embodiments.

FIG. 6F provides an exterior view of the completed bracket 204 in FIG. 6E. FIG. 6G is a top plan view of the completed bracket 204, and FIG. 6H is an end view of the completed bracket. From these views it can be seen that the spaced apart, upper and lower retention flanges 216, 218 are contoured to provide both clearance for the head of the fastener 140 adjacent the shoe plate 102 as well as clearance for the inner clamp 206 and leg pole 122. As best viewed in FIG. 6G, the upper retention flange 216 includes edge surfaces 216A, 216B, 216C and 216D. Similar surfaces are provided for the lower retention flange 218. Other clearance configurations for these surfaces can be used.

FIGS. 7A through 7E provide various views of the interior swivel clamp 206 in accordance with some embodiments. Other configurations can be used. As noted above, the interior swivel clamp 206 fits within and between the upper and lower retention flanges 216, 218, and is secured to the side portion 214 using the fastener 208 (see FIG. 5). Any number of suitable materials can be used to form the interior swivel clamp 206 including metal, plastic, etc. In one embodiment, the interior swivel clamp 206 is formed of extruded aluminum which is subsequently subjected to secondary machining operations to form the various apertures therein.

Figure 4:
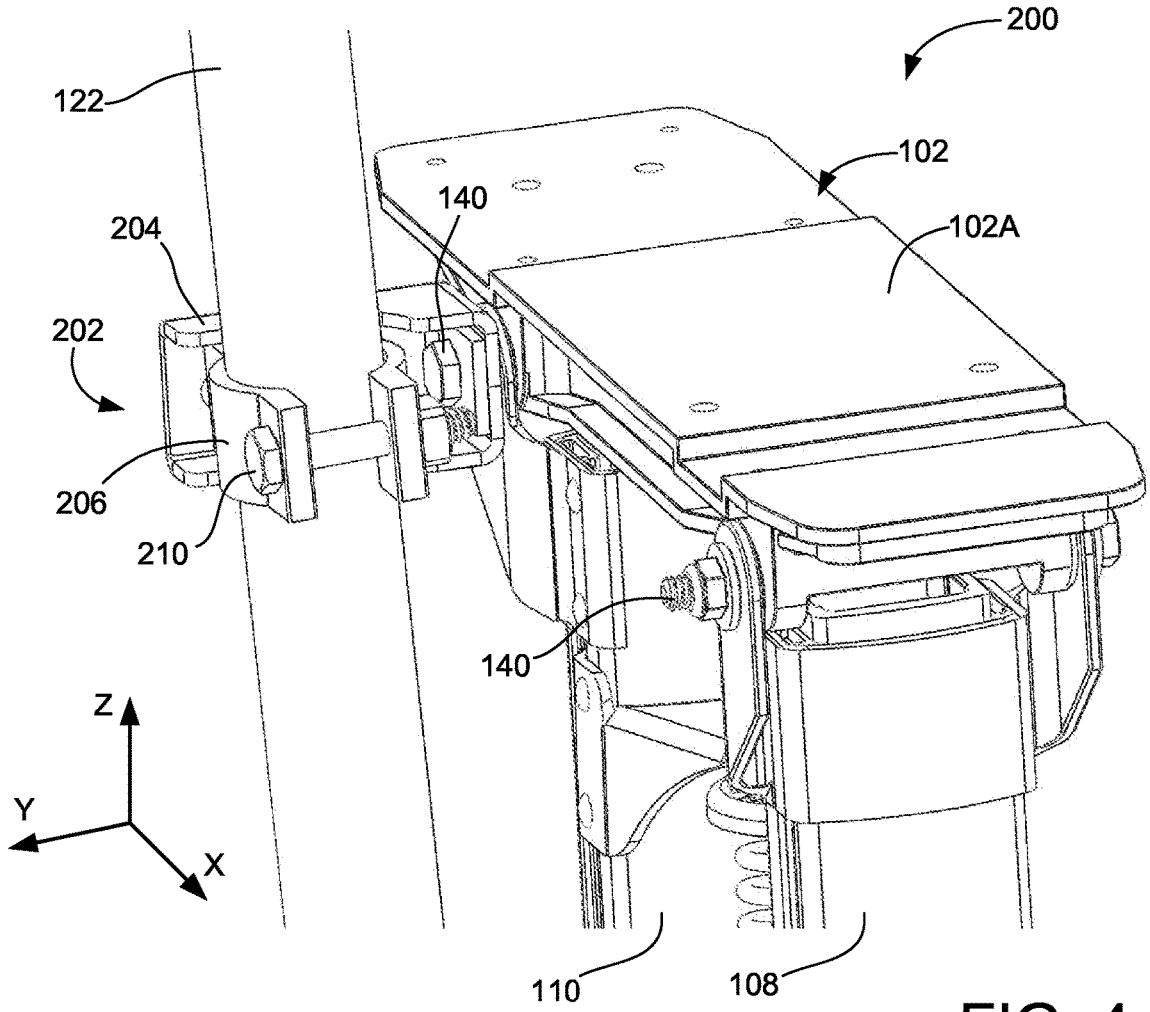
FIG. 4 shows a leg pole attachment assembly of the stilt device of FIG. 4 in some embodiments.

The interior swivel clamp 206 includes a base portion 230 and spaced apart, curvilinearly extending flanges 232, 234. The flanges 232, 234 terminate with nominally parallel tabs 232A, 234A, which are spaced apart and include corresponding through apertures 232B, 234B to accommodate the second fastener 210 (FIGS. 4-5). A corresponding aperture 230A extends in the X direction through the base portion 230 to accommodate the first fastener 208 (FIG. 5).

Figure 7A:
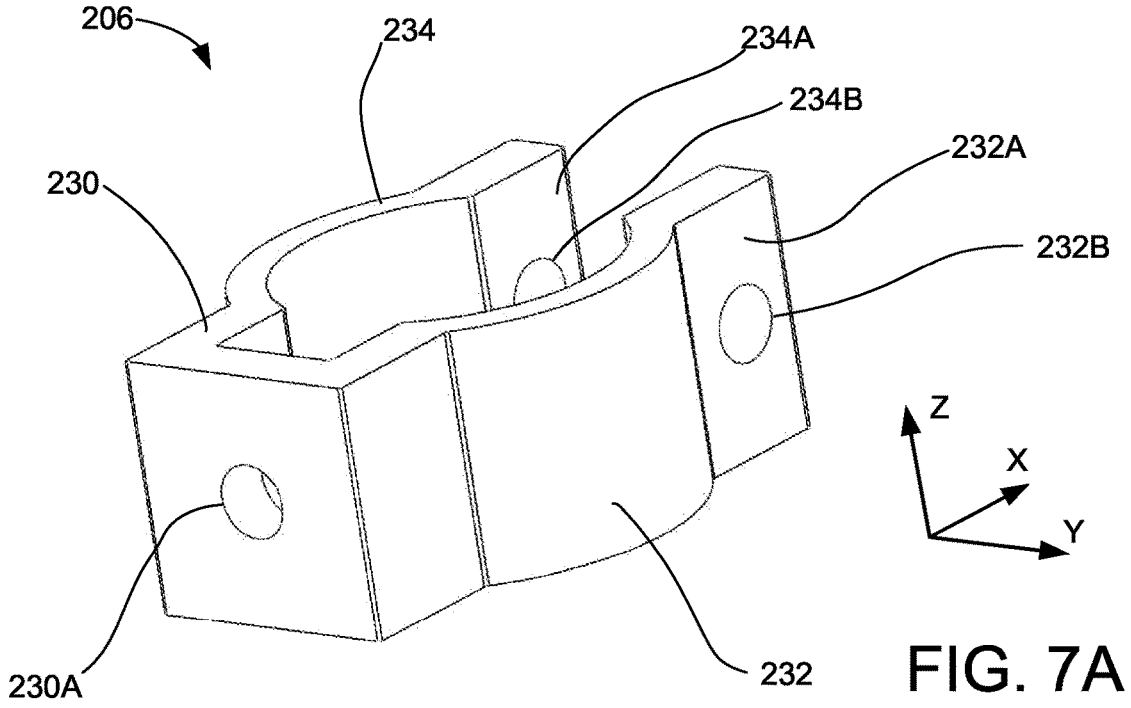
FIG. 7A is an isometric representation of an interior swivel clamp of the leg pole attachment assembly of FIGS. 3-5 in accordance with some embodiments.
Figure 7B:
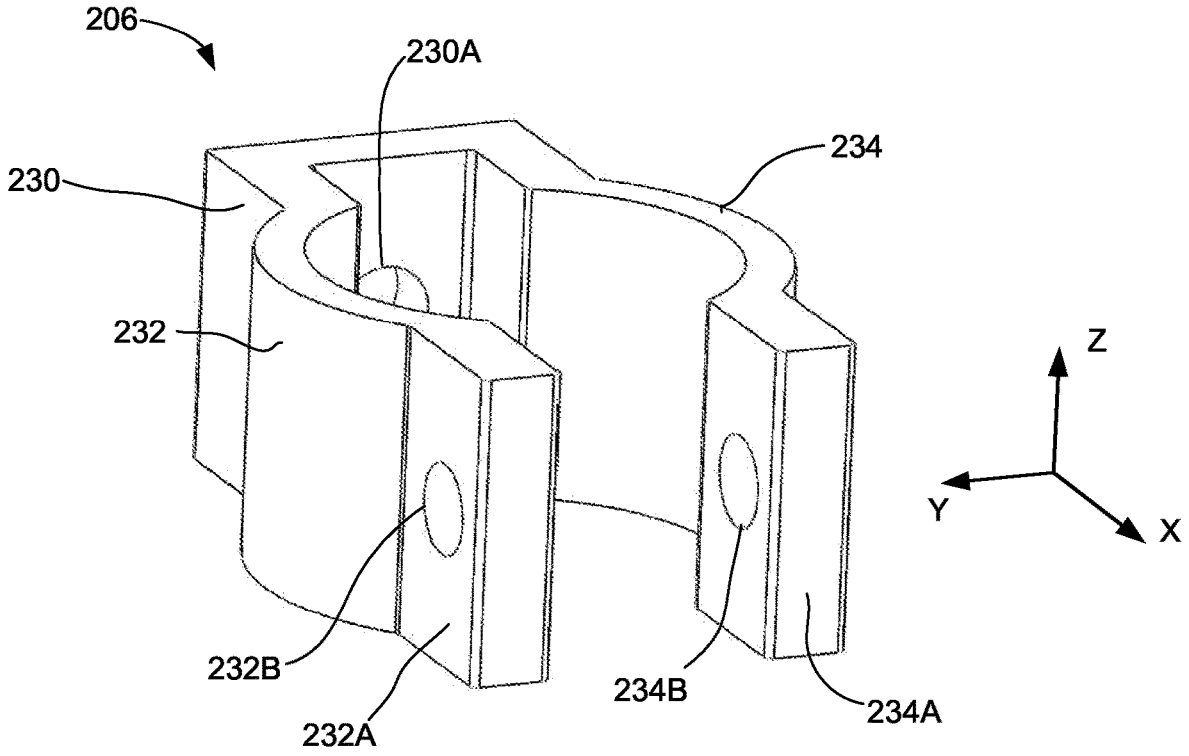
FIG. 7B is another isometric representation of the interior swivel clamp of FIG. 7A.
Figure 7C:
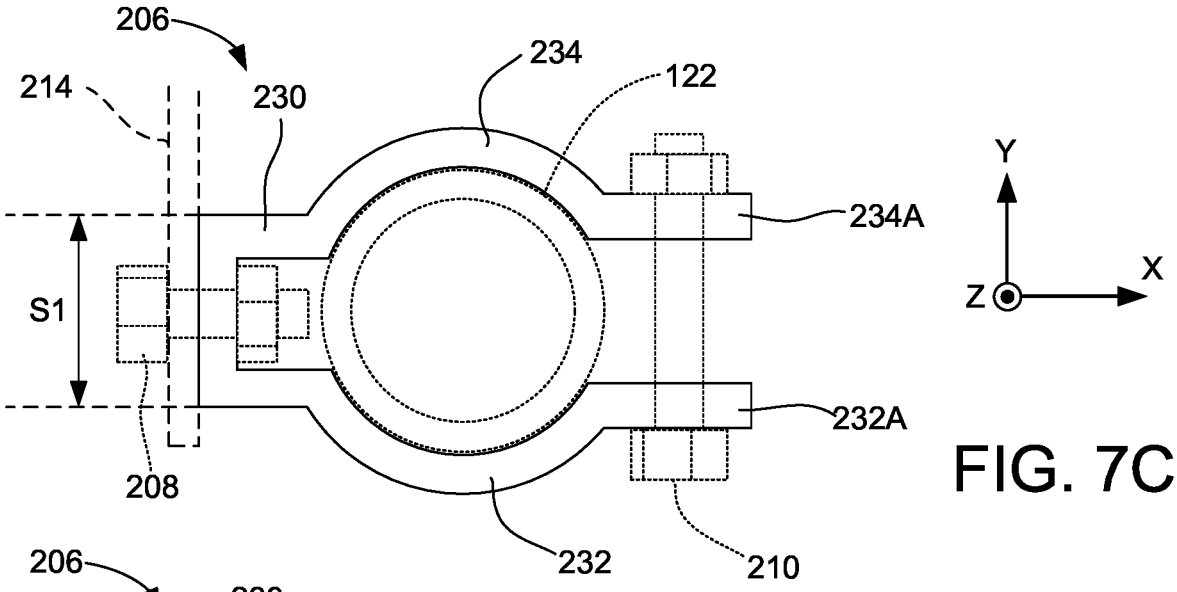
FIG. 7C is a top plan representation of the interior swivel clamp of FIG. 7A.
Figure 7D:
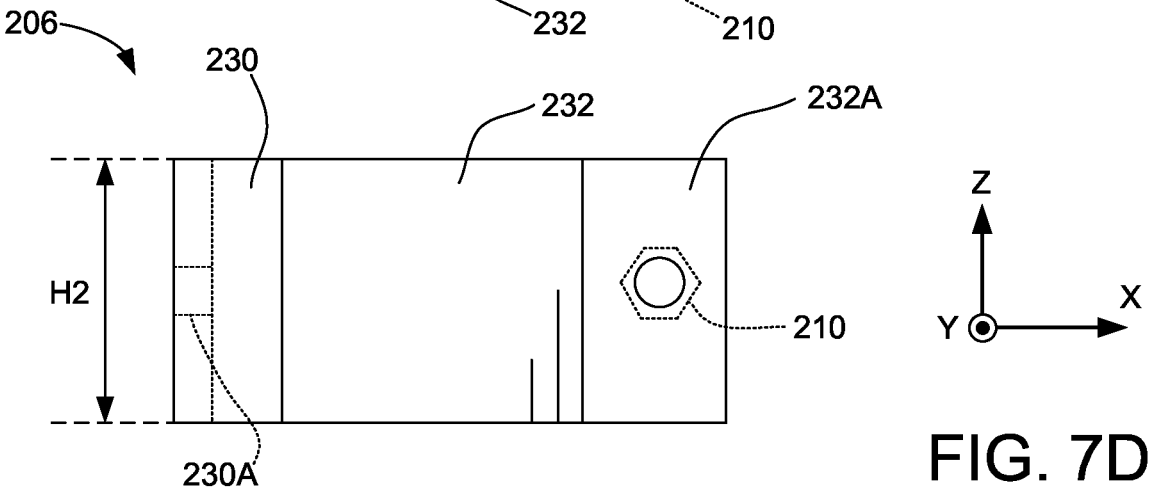
FIG. 7D is a side elevational representation of the interior swivel clamp of FIG. 7A.
Figure 7E:
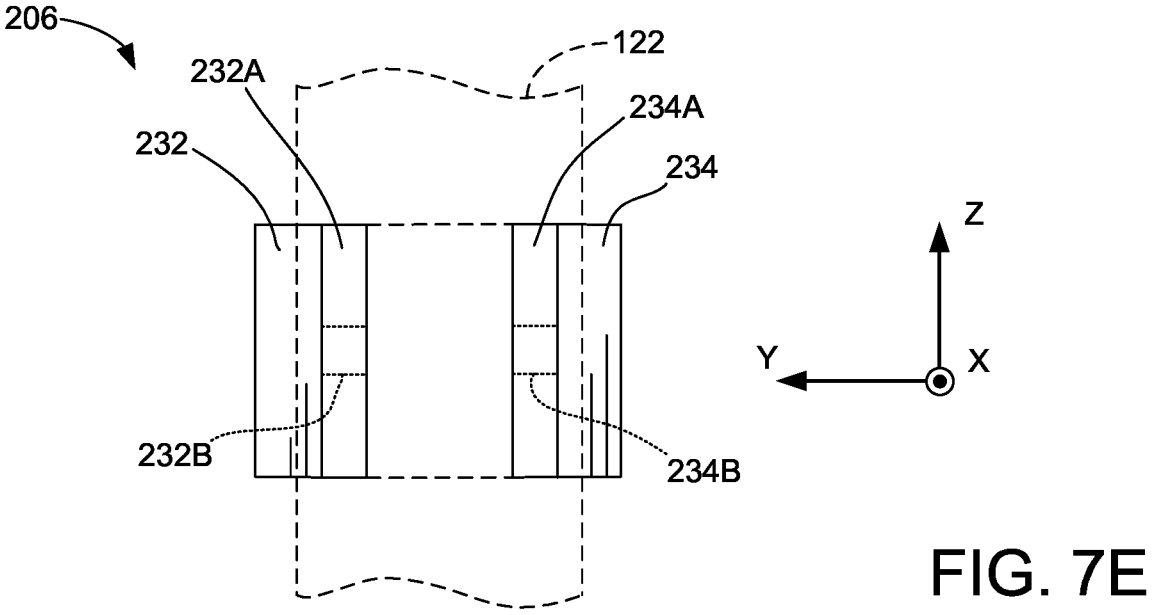
FIG. 7E is a front elevational representation of the interior swivel clamp of FIG. 7A.

The interior swivel clamp 206 has an overall span distance S1 as shown in FIG. 7C and an overall height H2 as depicted in FIG. 7D. The span distance S1 is the width along the Y direction of the base portion 230, and the height H2 is the height along the Z direction of the base portion 230. These respective dimensions S1 and H2 are less than the interior clearance height H1 of the exterior clamp bracket 204.

As a result, the interior clamp 206 has the capability of being swiveled (rotated) over a selected range of rotational motion within the c-shaped channel of the exterior clamp bracket 204. This limited swiveling capability is generally illustrated by various schematic drawings provided in FIGS. 8A through 8C.

Figure 8A:
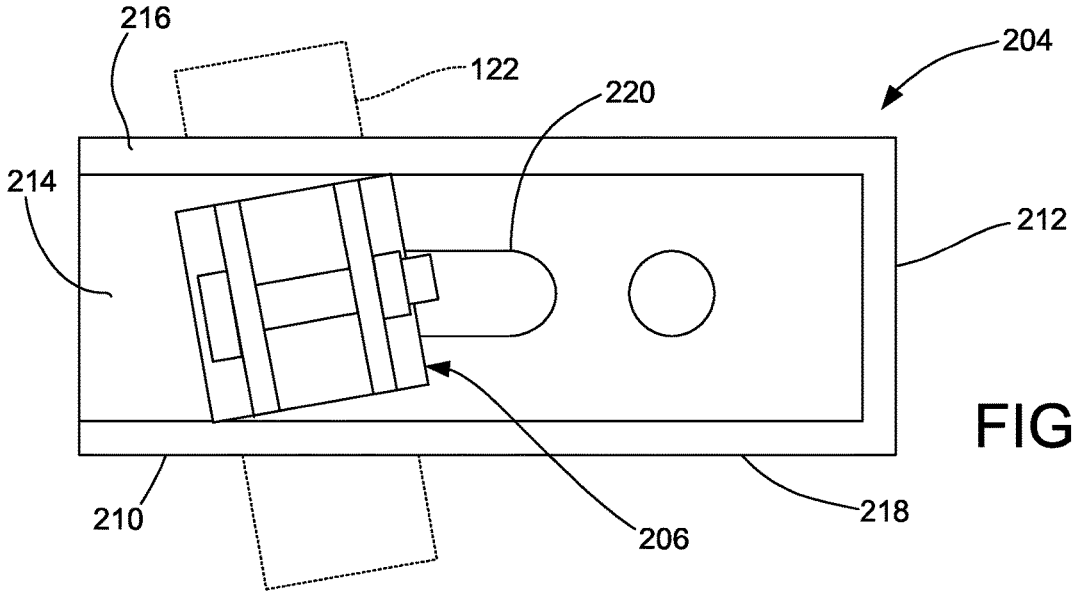
FIG. 8A is a schematic depiction of the leg pole attachment assembly of FIGS. 3-5 at a maximum swivel (rotational) position of about 20 degrees with respect to vertical in accordance with some embodiments.

In FIG. 8A, a maximum amount of swivel (rotation) has been applied to the interior clamp 206 with respect to the exterior clamp bracket 204. The respective corners of the base portion 230 contactingly engage the interior surfaces of the respective upper and lower retention flanges 216, 218, thereby allowing the maximum amount of angular rotation to the interior clamp 206 (and hence, the leg pole 122). A centered positioning of the interior clamp 206 is denoted in FIG. 8B.

Figure 8B:
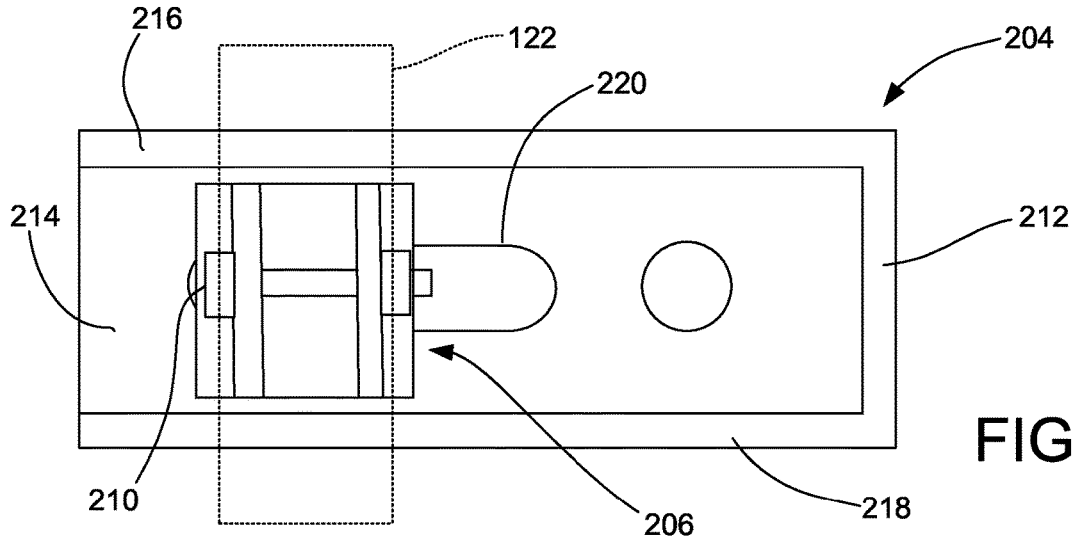
FIG. 8B corresponds to FIG. 8A but shows the leg pole attachment assembly at a neutral swivel (rotational) position of about zero (0) degrees with respect to vertical in accordance with some embodiments.

The amount of allowable swiveled movement of the interior clamp 206 with respect to the exterior clamp bracket 204 will depend on the requirements of a given application, but it is contemplated that these respective elements can be sized to accommodate an adequate range of motion. Without limitation, one exemplary range of motion may be upwards of from about 0 degrees to about 20 degrees or so, although other ranges can be used. It will be noted that the angle of rotation in FIG. 8A is about degrees and the angle of rotation in FIG. 8B is about zero (0) degrees. Any suitable swivel angle can be selected based on the requirements of the user.

Figure 8C:
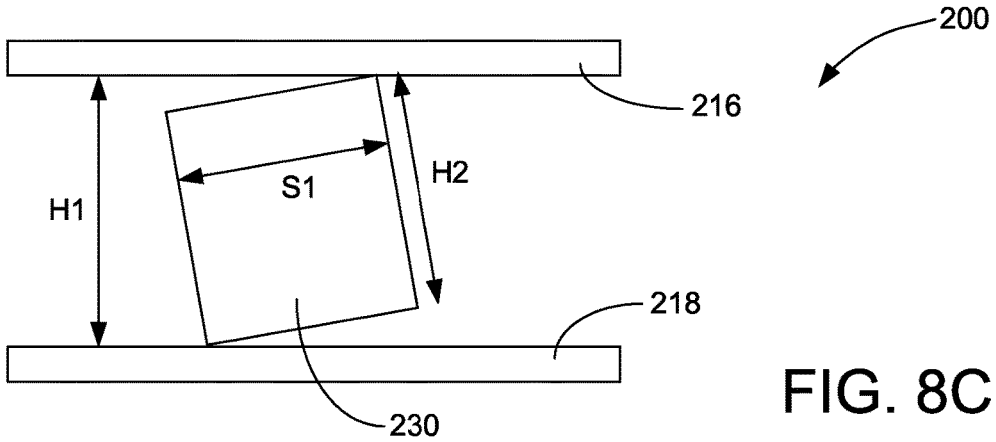
FIG. 8C is a schematic block diagram to illustrate various height and span dimensions utilized by the leg pole attachment assembly in some embodiments.

FIG. 8C is a schematic representation of the respective heights H1 and H2 and the span distance S1 for the stilt device 200. It will be noted that it is not necessary that the inner swivel clamp 206 be at the maximum angle so that the corners thereof contactingly engage the upper and lower flanges 216, 218. Rather, any suitable angle can be lockingly selected and maintained using the fasteners 208, 210 (FIGS. 4-5). Stated another way, it is contemplated that in at least some adjustment positions the base portion 230 of the swivel clamp 206 will be lockingly secured to the base portion 214 of the exterior clamp bracket 204 even if the base portion 230 is in a non-contacting, clearing relation to the interior facing surfaces of the upper and lower flanges 216, 218 (such as for example, for any selected angle less than the maximum angle shown in FIG. 8C).

It follows from the foregoing that the leg pole attachment assembly 202 as embodied herein can be configured to align the leg pole 122 in the vertical Z direction with the rear strut 110 while at the same time accommodating a large range of precise, pivotal adjustment of the angle of the leg pole 122 with respect to the vertical Z direction. The interior clamp 206 can be securely affixed to the vertically extending side portion 214 of the exterior clamp bracket 204 via the fastener 208, so that a tightened frictional contact will be sufficient to lock the interior clamp 206 in the desired orientation.

The upper and lower retention flanges 216, 218 provide strengthening to the side portion 214, ensuring that this mounting surface remains securely in place with respect to remaining portions of the stilt device 200. The upper and lower retention flanges 216, 218 further limit the maximum acceptable rotational movement of the interior clamp 206.

Figure 9:
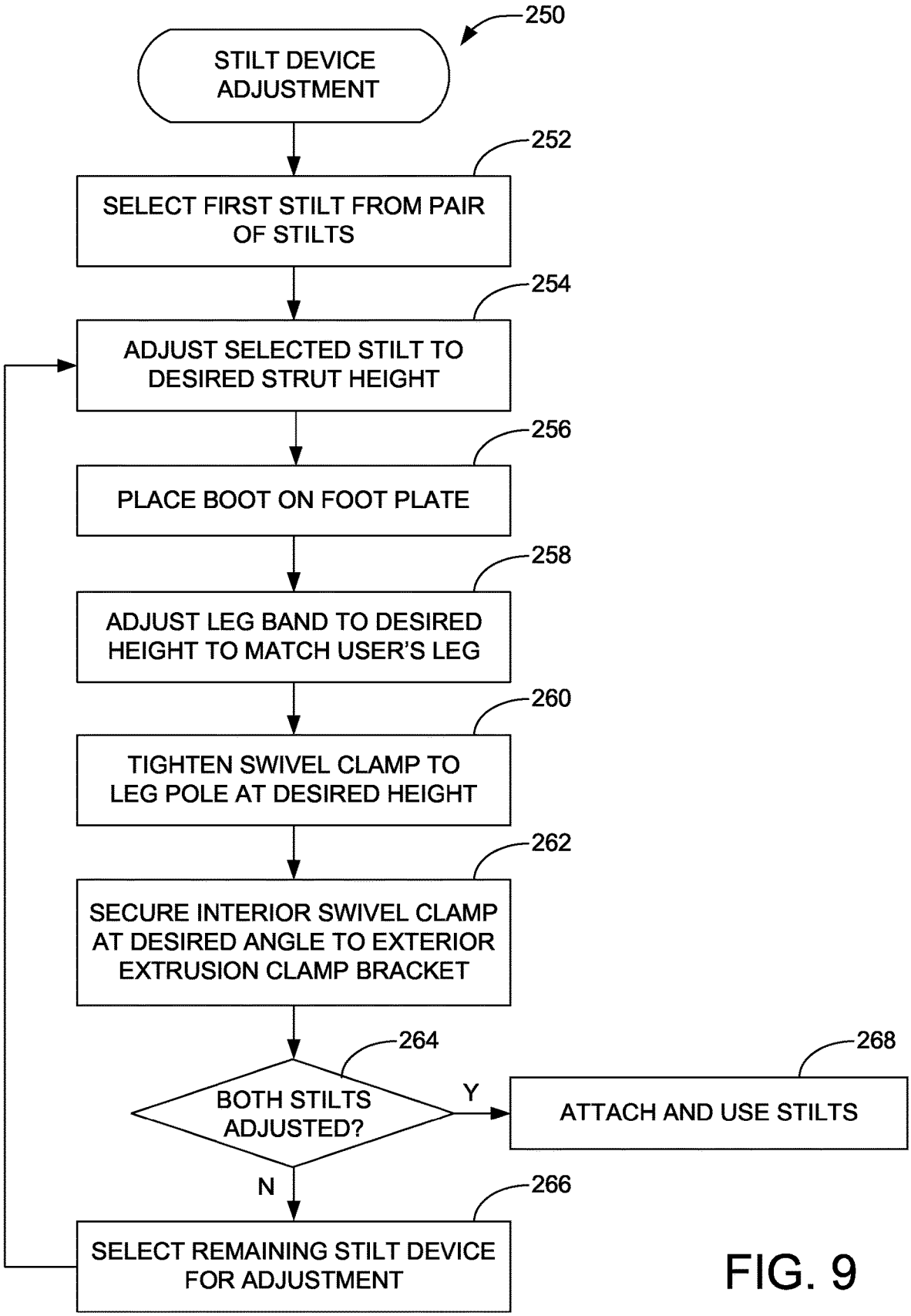
FIG. 9 is a flow chart for a stilt device adjustment routine carried out in accordance with various embodiments to adjust a pair of stilts constructed and operated in accordance with various embodiments.

FIG. 9 provides a flow chart for a stilt device adjustment routine 250 to illustrate operational steps that can be carried out in accordance with the foregoing discussion to adjust a pair of stilts for a particular user with the leg pole adjustment assembly as disclosed herein. It will be appreciated that the sequence 250 is merely exemplary to provide an overview, and other steps can be carried out as desired depending on the requirements of a given application. The steps can be carried out by the user, alone or with the aid of an assistant.

The sequence 250 is carried out for each of a pair of stilt devices to be worn by the user; that is, the operations may be performed to adjust a first stilt, such as a left-side stilt, followed by the adjustment of the remaining second stilt, such as a right-side stilt. For safety purposes, it is advisable that the user sit in a chair or other surface with the stilts extended forward, rather than attempting to stand on the stilts during these adjustment operations. Moreover, for safety purposes it is advisable that the user complete the adjustments for both stilts prior to securing and wearing the stilts. As always, all manufacturer's instructions provided with any pair of stilts, including all cautions and warnings, should be heeded and followed.

A first stilt from the pair is selected at step 252 (such as the right-side stilt). The relative height of the selected stilt is adjusted as desired at step 254. If utilized, the height adjustment can be utilized via adjustments to the telescopic struts 108, 110 as illustrated above. This adjustment will provide the overall elevation of the stilt(s) from the shoe plate 102 to the floor plate 104.

The user next places (without securing) the boot or other footwear of the user onto the shoe plate 102 of the selected stilt at step 256. This enables the user to adjust the leg band to the desired height so as to comfortably encircle the user's leg below the knee thereof, step 258. This adjustment may require the user to telescopically extend or retract the respective inner and outer sleeves 124, 126 of the leg pole 122 (see FIGS. 1A-1B). The leg band should not be secured to the user's leg at this time; rather, it is sufficient to raise or lower the leg band to the appropriate level and leave the stilt unattached to the user's leg.

Once the desired height and angle of the leg pole 122 is identified, the user proceeds at step 260 to tighten the interior swivel clamp 206 about the medial location of the leg pole 122. This is carried out by applying a suitable tool (such as a wrench, socket, etc.) to tighten the second fastener 210 (see FIG. 4).

The user thereafter secures the interior swivel clamp 206 to the exterior extrusion clamp 204 by applying a suitable tool to tighten the first fastener 208, thereby setting the desired angle and outboard position, as shown by step 262. This step secures the swivel clamp 206 to the base portion 214 of the exterior bracket 204. As noted above, if both the first and second fasteners 208, 210 are threaded bolts having the same bolt head size, the same tool can be used to tighten both of these bolts.

Decision block 264 determines whether both stilts have been adjusted; if not, the flow passes to step 266 where the remaining stilt device (such as the left-side stilt) is selected and the foregoing steps are repeated to properly adjust the remaining stilt.

Once both stilts have been adjusted, the flow then passes from step 264 to step 266, where the user thereafter secures the stilts to the user's respective legs and commences with use of the same in accordance with the manufacturer's instructions.

It will now be appreciated that the various embodiments disclosed herein provide a number of benefits over the existing art. The leg pole attachment assembly as embodied herein provides enhanced ranges of adjustment for the leg pole while ensuring vertical alignment of the leg pole with the rear strut. The enclosed c-shaped channel provides enhanced strength to the connection point and ensures that the leg pole will remain secured in the desired orientation to enhance user safety and comfort.

While various embodiments have contemplated the use of the rear strut attachment fastener (e.g., element 140) as a particularly suitable location at which to secure the leg pole attachment assembly to the shoe plate, such is merely exemplary and is not necessarily limiting.

Numerous possible variations and modifications will readily occur to the skilled artisan in view of the foregoing discussion, so it will be understood that the various exemplary embodiments disclosed herein are illustrative of, and are not limiting to, the scope of the claimed subject matter set forth below.

What is claimed is:

1. A stilt device comprising:

a floor plate configured for contacting support against an underlying base support surface which nominally lies along an X-Y plane;

a shoe plate configured to support a shoe worn on a foot of a user at a fixed distance above the floor plate by a support assembly comprising parallel, spaced-apart front and rear struts and an interconnected spring biased assembly that acts upon the front and rear struts via a biasing force to retain the front and rear struts, the floor plate, and the shoe plate in a rectilinear configuration;

a leg support assembly having a leg pole which extends upwardly from a medial portion of the rear strut and a leg securement mechanism at a distal end of the leg pole configured to attach to a leg of the user at a location below a knee thereof; and a leg pole attachment assembly configured to attach a medial portion of the leg pole to the rear strut and the shoe plate, comprising:

an exterior clamp bracket comprising a base portion affixed to the shoe plate, a side portion which extends vertically from the shoe plate having a horizontally extending aperture extending therethrough, a horizontal upper retention flange extending along a top edge of the side portion and a corresponding horizontal lower retention flange extending along a bottom edge of the side portion to form an enclosed c-shaped channel;

an interior swivel clamp comprising a base portion configured to swivel within the c-shaped channel and opposing flanges configured to surround and contactingly engage an outer circumferentially extending surface of the medial portion of the leg pole;

a first fastener extending horizontally through the side portion to lockingly engage the base portion of the interior swivel clamp at a selected angle; and a second fastener extending through the opposing flanges to clamp the interior swivel clamp to the leg pole.

2. The stilt device of claim 1, wherein the first fastener extends in a first horizontal direction parallel with the X-Y plane and the second fastener extends in a second direction orthogonal to the first horizontal direction and skewed with respect to the underlying base support surface.

3. The stilt device of claim 1, wherein the upper and lower retention flanges of the exterior clamp bracket are separated by a first interior height H1, and wherein the base portion of the interior swivel clamp has a second exterior height H2 less than H1 to facilitate limited rotation over an overall range of rotational motion of the base portion of the interior swivel clamp between the upper and lower retention flanges.

4. The stilt device of claim 1, further comprising a threaded fastener that collectively interconnects the base portion of the exterior clamp bracket, the shoe plate and the rear strut, the threaded fastener offset with respect to a central vertical axis of the rear strut.

5. The stilt device of claim 1, wherein the base portion of the interior swivel clamp does not contactingly engage the upper and lower retention flanges of the exterior clamp bracket when the first fastener contactingly secures the side portion of the exterior clamp bracket to the base portion of the interior swivel clamp.

6. The stilt device of claim 1, wherein the aperture extending through the side portion of the exterior clamp bracket is characterized as an elongated slot to facilitate sliding positioning of the interior swivel clamp along the c-shaped channel.

7. The stilt device of claim 1, wherein the upper and lower retention flanges of the exterior clamp bracket curvilinearly extend to provide clearance for swiveling motion of the interior swivel clamp within the c-shaped channel.

8. The stilt device of claim 1, wherein the leg pole is telescopic so as to have an outer sleeve coupled to the leg securement mechanism and an inner sleeve partially disposed within the outer sleeve coupled to the rear strut, and wherein the inner swivel clamp contactingly engages the outer sleeve of the leg pole.

9. The stilt device of claim 1, wherein the leg securement mechanism comprises a rigid leg band that circumferentially extends about an outer side of the user's leg, and a flexible strap that adjoins respective ends of the rigid band leg to circumferentially extend about an inner side of the user's leg.

10. The stilt device of claim 1, wherein the leg securement mechanism comprises a clamshell assembly with respective rigid band portions that are hinged together to fully surround the user's leg.

11. The stilt device of claim 1, wherein the base portion of the interior swivel clamp is sized to rotate over a rotational range of from about 0 degrees to about 20 degrees with respect to vertical within the c-shaped channel of the exterior clamp bracket.

12. The stilt device of claim 1, wherein each of the first and second fasteners are characterized as threaded bolts each having a common bolt head size to facilitate tightening using a common bolt tightening tool.

13. The stilt device of claim 1, wherein the exterior clamp bracket is formed from a planar piece of sheet metal which is subsequently folded at respective folding lines extending along at least two orthogonal directions to form the respective base portion, side portion and upper and lower retention flanges.

14. The stilt device of claim 13, wherein the planar piece of sheet metal is symmetric about a central axis and includes parallel first, second and third tabs extending from a first end of the planar piece of sheet metal, the planar piece of sheet metal processed to form the exterior clamp bracket by steps comprising:

folding each of the first, second and third tabs using a first folding process along a first direction orthogonal to the central axis so that each of the first, second and third tabs extends in a direction nominally orthogonal to remaining portions of the planar piece of sheet metal, the first tab bisected by the central axis, the second tab extending from a first side portion of the planar piece of sheet metal disposed on a first side of the central axis and the third tab extending from a second side portion of the planar piece of sheet metal disposed on an opposing second side of the central axis;

subsequently folding the respective first and second side portions using a second folding process along a second direction orthogonal to the first direction and parallel to the central axis, wherein the second folding process rotates the second and third tabs to be in facing abutment to the third tab; and welding the respective second and third tabs to the first tab.

15. In a stilt device of the type having a shoe plate supportable above a floor plate via front and rear struts to elevate a user above a horizontal floor surface and a leg attachment assembly configured to attach a leg of the user to the stilt via a leg attachment mechanism and a leg pole, an improved leg pole attachment assembly configured to attach a medial portion of the leg pole to the rear strut and the shoe plate, comprising:

an exterior clamp bracket comprising a base portion affixed to the shoe plate, a side portion which extends vertically from the shoe plate having a horizontally extending aperture extending therethrough, a horizontal upper retention flange extending along a top edge of the side portion and a corresponding horizontal lower retention flange extending along a bottom edge of the side portion to form an enclosed c-shaped channel; and an interior swivel clamp comprising a base portion configured to swivel within the c-shaped channel and opposing flanges configured to surround and contactingly engage an outer circumferentially extending surface of the medial portion of the leg pole, wherein a first fastener extends horizontally through the side portion to contactingly lock the base portion of the interior swivel clamp to the side portion at a selected angle, and wherein a second fastener extends through the opposing flanges of the interior swivel clamp to clamp the interior swivel clamp to the leg pole.

16. The improved leg pole attachment assembly of claim 15, wherein the first fastener extends in a first direction toward a central axis of the leg pole on a first side of the leg pole, and wherein the second fastener extends in a second direction orthogonal to the first direction on an opposing, second side of the leg pole.

17. The improved leg pole attachment assembly of claim 15, wherein the upper and lower retention flanges of the exterior clamp bracket are separated by a first interior height H1, and wherein the base portion of the interior swivel clamp has a second exterior height H2 less than H1 and an overall span distance S1 less than H1 to facilitate limited rotation over an overall range of rotational motion of the base portion of the interior swivel clamp within the c-shaped channel between the upper and lower retention flanges.

18. The improved leg pole attachment assembly of claim 17, wherein the overall range of rotational motion of the base portion of the interior swivel clamp within the c-shaped channel between the upper and lower retention flanges is from about 0 degrees to about 20 degrees with respect to vertical.

19. The improved leg pole attachment assembly of claim 15, wherein the base portion of the exterior clamp bracket is secured to the rear strut and the shoe plate using a threaded fastener disposed toward a rear of the shoe plate and offset from a vertically extending central axis of the rear strut.

20. The improved leg pole attachment assembly of claim 15, wherein opposing top and bottom surfaces of the base portion of the interior swivel clamp do not contactingly engage the upper and lower retention flanges of the exterior clamp bracket when the first fastener contactingly secures the side portion of the exterior clamp bracket to the base portion of the interior swivel clamp.

21. The improved leg pole attachment assembly of claim 15, wherein the aperture extending through the side portion of the exterior clamp bracket is characterized as an elongated slot to facilitate sliding positioning of the interior swivel clamp along the c-shaped channel.

22. The improved leg pole attachment assembly of claim 15, wherein the upper and lower retention flanges of the exterior clamp bracket curvilinearly extend to provide clearance for swiveling motion of the interior swivel clamp within the c-shaped channel.

23. The improved leg pole attachment assembly of claim 15, wherein the exterior clamp bracket is formed from a flat piece of sheet metal which is subsequently folded at respective folding lines extending along at least two orthogonal axes to form the respective base portion, side portion and upper and lower retention flanges.

24. The improved leg pole attachment assembly of claim 23, wherein folded tabs of the flat piece of sheet metal are spot welded together to form the base portion of the exterior clamp bracket.

* * * * *